US005380032A

United States Patent [19]

Challande et al.

[11] Patent Number: 5,380,032

[45] Date of Patent: Jan. 10, 1995

[54] SUB-ASSEMBLY EFFECTING THE ELASTIC RETURN OF THE POSITION-RETENTION DEVICE BELONGING TO A SKI BINDING

[75] Inventors: Christian Challande, Cruseilles; Pierre Desarmaux, Evires, both of France

[73] Assignee: Salomon S.A., Chavanod, France

[21] Appl. No.: 45,132

[22] Filed: Apr. 12, 1993

[30] Foreign Application Priority Data

Apr. 10, 1992 [FR] France ..... 92 04590

[51] Int. Cl.[6] ..... A63C 9/22

[52] U.S. Cl. ..... 280/634; 116/DIG. 11

[58] Field of Search ..... 280/625, 626, 629, 633, 280/634; 116/DIG. 11

[56] References Cited

U.S. PATENT DOCUMENTS

| | | | |
|---|---|---|---|
| 3,774,925 | 11/1973 | Jungkind | 280/634 |
| 4,061,358 | 12/1977 | Murata | 280/629 |
| 4,758,017 | 7/1988 | Stritzl et al. | 280/634 X |
| 4,765,641 | 8/1988 | Peyre | 280/634 X |
| 4,979,762 | 12/1990 | Gallet | 280/634 X |

FOREIGN PATENT DOCUMENTS

| | | |
|---|---|---|
| 2217040 | 9/1974 | France . |
| 3403113 | 8/1984 | Germany . |

*Primary Examiner*—Eric D. Culbreth
*Assistant Examiner*—Peter C. English
*Attorney, Agent, or Firm*—Pollock, Vande Sande & Priddy

[57] ABSTRACT

A sub-assembly effecting the elastic return of the position-retention device belonging to an alpine ski binding, comprising a compression spring (6), an adjustment screw (7) passing completely through the spring (6), and a nut (10) forming a support stop for one of the ends of the spring and screwed onto the threaded end of the screw, and a device (5) connecting with the position-retention device of the binding. The screw (7) incorporates, in its central part, a shoulder (16) against which the nut (10) abuts in the end compression position of the spring, and, in that position, the turns of the spring remain spaced apart. The nut (10) is preferably made of a plastic material and incorporates a capsule (19) on the side facing the shoulder (16).

5 Claims, 2 Drawing Sheets

SUB-ASSEMBLY EFFECTING THE ELASTIC RETURN OF THE POSITION-RETENTION DEVICE BELONGING TO A SKI BINDING

FIELD OF THE INVENTION

The invention concerns a sub-assembly effecting the elastic return of the position-retention device belonging to an alpine ski binding.

BACKGROUND OF THE INVENTION

In conventional fashion, an alpine ski binding incorporates a device for position-retention of one end of the boot, this device being moveable in opposition to the elastic return force of a spring, which, in the case of the present invention, is a compression spring. The position-retention device transmits its stresses to the spring by means of a connecting device, such as a piston. Furthermore, the spring must be equipped with means allowing adjustment of its initial compression, i.e., its initial return pretensioning, and with other means for displaying the initial spring compression corresponding to the adjustment hardness imparted to the binding.

Bindings are known in which the spring is a compression spring, whose initial compression is generated using a screw which passes completely through the spring and which comprises, at the end opposite its head, a nut forming a stop for one of the ends of the spring. A device of this kind is known, for example, from applicant's German Patent Application No. DE 40 39 707.

This type of stop gives rise to the problem of preventing excessive tightening of the screw from causing compression of the spring incorporating contiguous turns, a phenomenon which would obviously prevent the spring from then performing its elastic-return function.

Another problem consists in producing, simply and economically, the stop-nut and the device displaying spring compression, while ensuring high resistance to wear of this nut.

SUMMARY OF THE INVENTION

The sub-assembly effecting the elastic return of the position-retention device belonging to an alpine binding, according to the invention, comprises a compression spring, an adjustment screw which passes completely through the spring, a nut forming a support stop for one end of the spring and which is screwed onto the threaded end of the screw, an indicator for display of spring compression, and a device connecting with the position-retention device, which is moveable parallel to the axis of the spring in conjunction with the movements of the position-retention device. This sub-assembly is characterized by the fact that the central position of the screw has a shoulder against which the nut abuts in the end compression position of the spring, and that, in this position, the turns of the spring remain spaced apart.

BRIEF DESCRIPTION OF THE DRAWINGS

The invention will be better understood with reference to the following description and to the attached drawings forming an integral part of the latter.

DESCRIPTION OF THE PREFERRED EMBODIMENT

Figure 1:
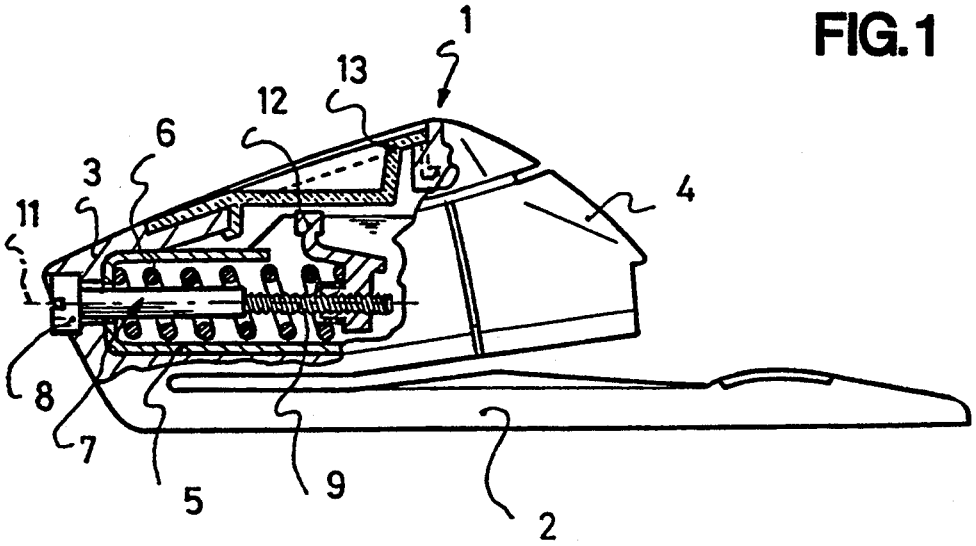
FIG. 1 is a side view, in partial cross-section, of a front binding equipped with an elastic-return sub-assembly according to a first embodiment of the invention.

FIG. 1 shows a binding 1 which, in conventional fashion, has a base 2 firmly fastened to the ski and surmounted by a body 3. The body 3 carries a device for position-retention of the boot, shown in FIG. 1 as a position-retention wing 4. In conventional fashion, the wing is movable around an approximately vertical axis, when acted upon by the stresses generated by the boot. The outward motion of the wing 4 causes the rearward translational movement, in a substantially horizontal direction, of a piston 5 functioning in opposition to the elastic return force of a compression spring 6 housed inside the piston 5.

The initial compression of the spring 6 is adjusted by means of a screw 7, whose head 8 is accessible from the outside in the area of the front end of the binding. The head 8 is supported against the body 3, then passes through the piston and then the spring. At the end opposite the head 8, the screw 7 has a threaded portion 9 on which a nut 10 forming a stop is screwed, and against which the rear end of the spring rests. Moreover, means to be described below, prevent the nut 10 from following the rotation of the screw during an adjustment motion.

Rotation of the screw 7 causes the translational motion of the nut 10 along the axis 11 of the screw, and hence compression or decompression of the spring 6.

An indicator 12 visible from the outside through a transparent plate 13 equipping the upper cover of the body 3 travels with the nut 10.

Figure 2:
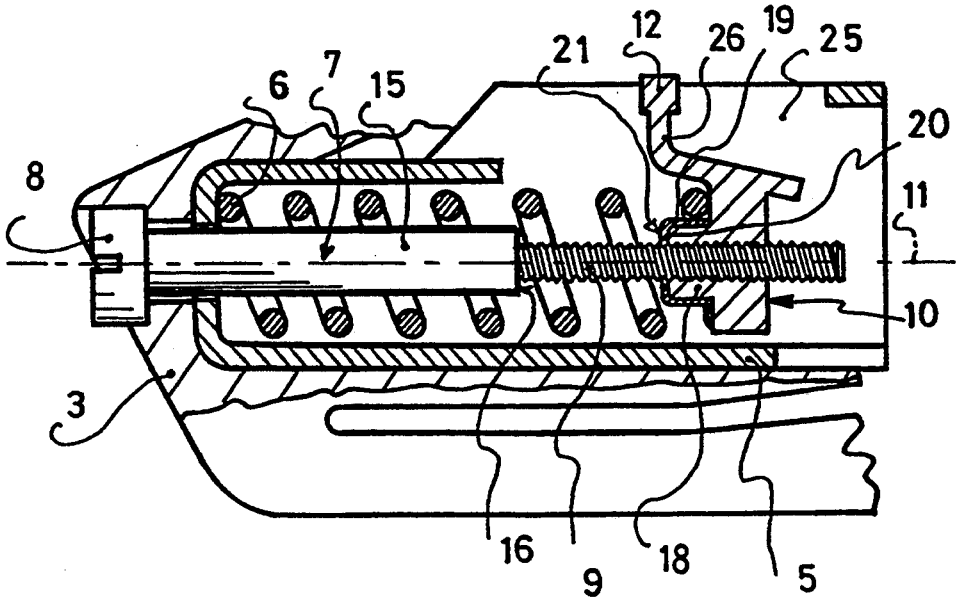
FIG. 2 is a side view, in cross-section in a longitudinal, vertical plane, of the elastic-return sub-assembly equipping the binding in FIG. 1.

In FIG. 2, the screw 7 has, between the head 8 and the threaded portion 9, a smooth body 15 whose diameter is manifestly greater than the diameter of the threaded portion 9 and smaller than the inner diameter of the turns of the spring 6. The difference in diameter between the smooth body 15 and the threaded portion 9 forms a shoulder 16 at the boundary between these two parts of the screw.

In the embodiment shown in FIG. 2, the nut 10 is made of a molded plastic material and incorporates, on the side facing the screwhead, a projecting connector 18 whose inner part is threaded and whose outer surface is a cylindrical shape generated by revolution.

A ring 19, preferably made of metal, is engaged on the connector 18, and its inner diameter is adjusted to the outer diameter of the connecting piece. The ring 19 prevents deformation of the connecting piece, and, in particular, its expansion when, following rotation of the screw 7, the connecting piece 18 reaches a position abutting the shoulder 16.

The outer diameter of the ring 19 is substantially smaller than the inner diameter of a turn, so that the ring fits inside the spring. Preferably, on the side facing the screwhead, the ring 19 is closed by means of a return 20, which supplies a substantially vertical support face and whose function will be explained below.

To the rear of the connecting piece 18, the nut 10 is fitted with a washer 21 which supplies a vertical stop surface, against which the end of the spring is supported.

The rotation of the screw producing compression of the spring is limited by the stop action of the return 20 on the ring 19 against the shoulder 16 of the screw.

This contact between the ring and the shoulder of the screw reduces the rotation of the screw, a particularly advantageous phenomenon when the screw is rotated using a tool on the binding production line. Furthermore, the ring 19 prevents the expansion of the nut 10 when the nut is stopped against the shoulder 16 of the screw. In this way, damage to the threads of the nut 10 is avoided. In addition, it should be noted that the use of a plastic material to make the nut 10 is economical, but also makes it possible to produce, between the nut and the screw threads, a high coefficient of friction, thereby preventing untimely loosening of the screw/nut assembly.

Figure 3:
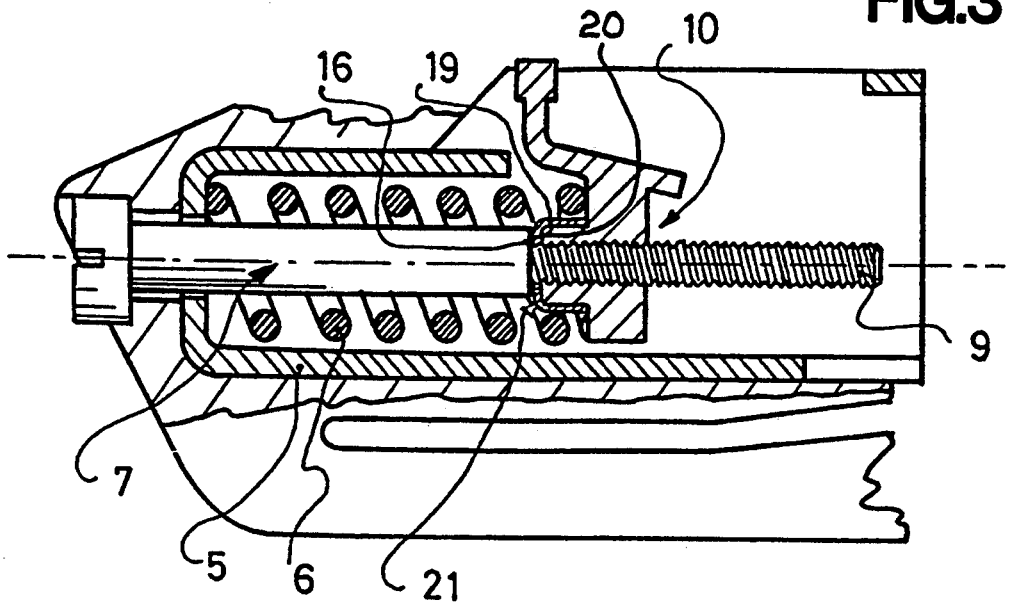
FIG. 3 illustrates the sub-assembly in FIG. 2 in another operating position.

FIG. 3 illustrates the nut 10 and the screw 7 in the end compression position of the spring 6.

The shoulder 16 of the screw is located at a distance from the head such that the turns of the spring 6 continue to be spaced apart. Thus, the spring can be compressed additionally in response to the movements of piston 5 caused by opening the wings. The spring thus retains an elastic-return function, whatever the position of the nut 10.

Good results have been achieved using a metal ring 19 and its return 20; however, these components could be made of another material, e.g., a plastic material whose quality is different from that of the nut 10.

In the embodiment shown in FIG. 2, the upper part of piston 5 has a longitudinal slot-shaped opening 25. A finger 26 firmly attached to the nut 10 passes through this opening. The finger 26 and the nut 10 are advantageously molded from a single piece. The finger 26 supports, at its upper end, the indicator 12 allowing display of the state of compression of the spring. This indicator 12, or else the upper portion of the finger 26, is supported in the lateral walls of the opening 25 in the piston, thereby preventing the nut 10 from being driven in rotation when the screw is rotated.

The length of the opening 25 is determined in accordance with the longitudinal travel of the nut 10 along the screw, and with the longitudinal travel of the piston 5 as a result of the stresses generated by the boot on the position-retention device.

Thus, the indicator is produced very simply, since it is made in one piece with the nut 10. Furthermore, in addition to its indicator function, the indicator prevents rotation of the nut.

Figure 4:
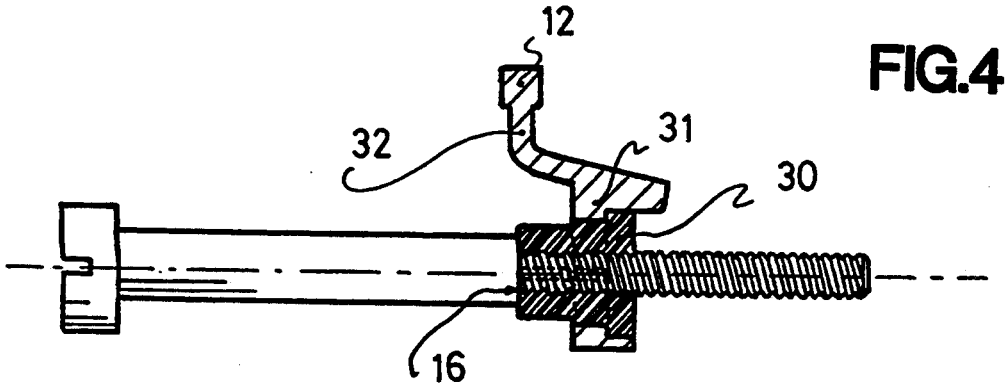
FIG. 4 illustrates a variant.

FIG. 4 illustrates a variant of the nut. In this variant, the nut comprises a metal insert 30, which has a threaded orifice in its central section. An element 31 made of a plastic material is fitted on the insert, and this element is extended upward by a finger 32 surmounted by the indicator 12 previously described.

The insert incorporates laterally at least one, and preferably two, slots 33 parallel to the axis of the screw. Complementarily, the element 31 has one, and preferably two, tongues 34 which are inserted in the slots 33 in the insert 30. These tongues 34 come into contact with the threaded portion of the screw, and constitute a brake restricting the rotation of the screw in relation to the nut.

Figure 5:
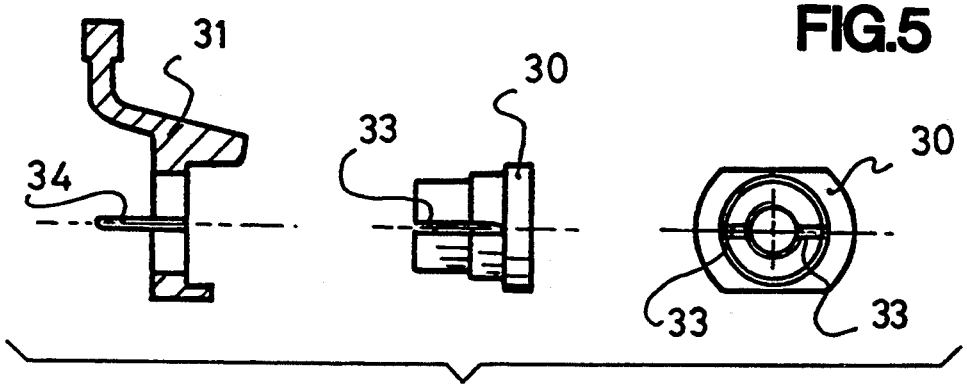
FIG. 5 is an exploded side view of the different components of the device in FIG. 4.

The nut, illustrated in FIGS. 4 and 5, functions in the same way as does the nut previously described. In the case under consideration, the end of the insert positioned on the side facing the screwhead abuts against the shoulder 16 of the screw, so as to limit its movement of rotation in the direction which generates compression of the spring.

As in the preceding case, when the insert 30 is stopped against the shoulder 16 of the screw, the turns a spring 6 are preferably not contiguous. In this way, the spring continues to retain a certain pressure stroke.

What is claimed is:

1. Ski binding comprising a position-retention element and a device for effecting elastic return of said position-retention element, said device comprising a compression spring (6) comprising turns, an adjustment screw (7) passing completely through said spring, a nut (10) forming a support stop for one of the ends of said spring and screwed on a threaded end (9) of said screw, and a device (5) connected to said position-retention element and movable parallel to a longitudinal axis of said spring in conjunction with movements of said position-retention element, said device (5) connected to said position-retention element housing said spring (6) and opposing an elastic return force of said spring, wherein said screw has a central portion comprising a shoulder (16) against which said nut (10) abuts in an end compression position of said spring, and, in said end compression position, the turns of said spring remain spaced apart, said nut (10) being made of plastic material and being partially enclosed by a circular metal ring (19) which prevents expansion of said nut when said nut abuts against said shoulder (16) of said screw in said end compression position of said spring.

2. Ski-binding according to claim 1, wherein said ring (19) has an outer diameter smaller than an inner diameter of said spring (6).

3. Ski binding according to claim 1, wherein said metal ring (19) has, on a side of said metal ring facing said shoulder (16), a return (20) which extends toward an axis of said screw and which constitutes a face supporting the nut against said shoulder (16) of said screw in said end compression position of said spring.

4. Ski-binding according to claim 1, wherein said nut (10) supports a finger (26) which is guided in a longitudinal slot (25) in said device (5) connected to said position-retention elements, said finger preventing rotation of said nut.

5. Ski binding according to claim 4, comprising an indicator (12) supported by said finger and displaying the compression of said spring.

* * * * *